US007337732B2

(12) United States Patent
Becker et al.

(10) Patent No.: US 7,337,732 B2
(45) Date of Patent: Mar. 4, 2008

(54) QUICK ASSEMBLY HOME ENTERTAINMENT SYSTEM STAND AND METHOD FOR ASSEMBLING THE SAME

(75) Inventors: William M. Becker, Washington, DC (US); Cristian R. Wicha, Falls Church, VA (US); Matthew Weatherley, Fairfax, VA (US)

(73) Assignee: Becker Designed, Inc., Chantilly, VA (US)

( * ) Notice: Subject to any disclaimer, the term of this patent is extended or adjusted under 35 U.S.C. 154(b) by 280 days.

(21) Appl. No.: 11/104,477

(22) Filed: Apr. 13, 2005

(65) Prior Publication Data

US 2006/0230993 A1 Oct. 19, 2006

(51) Int. Cl.
*A47B 3/00* (2006.01)

(52) U.S. Cl. ..... 108/193; 108/115; 108/184; 312/258

(58) Field of Classification Search ..... 312/258, 312/262, 265.5, 257.1, 263, 7.2; 108/115, 108/180, 184, 187, 193, 162, 176; 211/149, 211/150, 134, 195, 104
See application file for complete search history.

(56) References Cited

U.S. PATENT DOCUMENTS

| | | | | |
|---|---|---|---|---|
| 771,731 | A | 10/1904 | Johnson | |
| 2,764,462 | A | 9/1956 | McDonald | |
| 3,644,011 | A * | 2/1972 | MacDonald | 312/258 |
| 3,752,552 | A * | 8/1973 | MacDonald | 312/258 |
| 3,955,864 | A * | 5/1976 | MacDonald et al. | 312/258 |
| 4,202,586 | A | 5/1980 | Oplinger | |
| 4,482,195 | A * | 11/1984 | Chapin | 312/210 |
| 4,539,599 | A * | 9/1985 | Revelin | 348/838 |
| 5,308,157 | A | 5/1994 | Dyer | |
| 5,345,882 | A * | 9/1994 | Yamada | 108/193 |
| 5,480,119 | A | 1/1996 | Fish et al. | |
| 5,738,230 | A | 4/1998 | Goldstein | |
| 6,039,419 | A | 3/2000 | Brown et al. | |
| D467,099 | S * | 12/2002 | Antonioni | D6/479 |
| D474,627 | S | 5/2003 | Wicha | |
| D476,173 | S | 6/2003 | Wicha | |
| D485,702 | S | 1/2004 | Becker | |
| 6,722,750 | B2 | 4/2004 | Chan | |
| D494,781 | S * | 8/2004 | Wicha | D6/479 |
| D507,901 | S * | 8/2005 | Wicha | D6/477 |
| 2004/0046486 | A1 | 3/2004 | Wicha | |
| 2005/0067926 | A1 * | 3/2005 | Chiang | 312/258 |

* cited by examiner

*Primary Examiner*—Janet M. Wilkens
(74) *Attorney, Agent, or Firm*—Buchanan Ingersoll & Rooney, PC

(57) ABSTRACT

A home entertainment system storage unit includes a front frame having an upper portion, a bottom portion, and first and second side portions extending therebetween. A first side member is hingedly connected to a rear surface of the front frame, the first side member being movable between a first storage position generally adjacent the front frame and a second active position generally perpendicular to the front frame, a rear edge of the first side member includes a vertically extending channel. A second side member is hingedly connected to the rear surface of the front frame, the second side member being movable between a first storage position generally adjacent the front frame and a second active position generally perpendicular to the front frame, a rear edge of the second side member includes a vertically extending channel. A rear panel is slidably receivable within the channels of the first and second side members.

8 Claims, 10 Drawing Sheets

QUICK ASSEMBLY HOME ENTERTAINMENT SYSTEM STAND AND METHOD FOR ASSEMBLING THE SAME

FIELD OF THE INVENTION

The present invention is directed to a home entertainment system stand, and more particularly, to a high quality furniture unit that is easily and quickly assembled and moved by the consumer.

BACKGROUND OF THE INVENTION

Home entertainment system equipment is more and more becoming an integral and significant part of modern living. Historically, one would without much contemplation find a place to put a simple radio, T.V., or stereo system. Now, the proliferation of separate components, such as tuner, preamplifier, power amplifier, DVD player, compact disk player, satellite receiver, digital video recorder, center channel speakers and digital television monitors, and the necessity to properly locate and interconnect selected ones of these components, has made storage and access to these components a necessity.

Inexpensive stands, that require user assembly, often are not well designed with the thought of component size in mind. Venting of the component heat is often poor, and may result in obvious holes and vents which detract from the aesthetic appeal of these stands. Additionally management of the considerable number of cables is typically an afterthought.

Better quality stands have improved appearance but may still not be carefully designed for home entertainment systems. For example fixed shelves do not take into account component size which often requires varying shelf clearance. Furthermore these stands can take a considerable amount of time to assemble. Even assembly for store display of the stand can be an issue as employee labor rates are high and time is often of the essence during new store openings and busy selling seasons. Additionally, consumers often struggle with assembling stands that require many assembly steps and proper orientation of parts.

Shipping costs have also become a major factor in home entertainment system furniture. Fuel costs, container costs, etc have contributed to much higher transport costs. These costs are dependent on box dimensions and overall volume so the more compactly a stand can ship the greater savings that will result.

Accordingly, there is a need for better quality home entertainment system stands which are compact to ship and are easily and quickly assembled by the consumer, delivery person or store personnel, and which allow multiple configurations for the arrangement of home entertainment system components.

SUMMARY OF THE INVENTION

The present invention meets these needs by providing a home entertainment system storage unit comprising a front frame having an upper portion, a bottom portion, and first and second side portions extending therebetween; a first side member hingedly connected to a rear surface of said front frame, said first side member being movable between a first storage position generally adjacent said front frame and a second active position generally perpendicular to said front frame, a rear edge of said first side member including a vertically extending channel; and a second side member hingedly connected to the rear surface of said front frame, said first side member being movable between a first storage position generally adjacent said front frame and a second active position generally perpendicular to said front frame, a rear edge of said second side member including a vertically extending channel. A rear panel is slidably receivable within said channels of said first and second side members, a first of a plurality of shelves is supported on a bottom member of said front frame and a second of said plurality of shelves is supported on an upper member of said front frame.

According to a further embodiment of the present invention, a method is provided for assembling a portable home entertainment system storage unit. The method comprises providing a front frame having an upper portion, a bottom portion, and first and second side portions extending therebetween; a first side member hingedly connected to a rear surface of said front frame, said first side member being movable between a first storage position generally adjacent said front frame and a second active position generally perpendicular to said front frame, a rear edge of said first side member including a vertically extending channel; and a second side member hingedly connected to the rear surface of said front frame, said second side member being movable between a first storage position generally adjacent said front frame and a second active position generally perpendicular to said front frame, a rear edge of said second side member including a vertically extending channel; unfolding said first side member from the first storage position to the second active position; unfolding said second side member from the first storage position to the second active position; positioning a rear panel above said vertically extending channels on the rear edges of said first and second side members and sliding the rear panel downward within said channels; positioning a first shelf on a bottom portion of the front frame and a lower member of each of the side members; and positioning a second shelf on an upper portion of the front frame and an upper member of each of the side members.

Still further, according to a further embodiment of the present invention, a home entertainment system storage unit comprises a front frame having an upper portion, a bottom portion, and first and second side portions extending therebetween; a first side member hingedly connected to a rear surface of said front frame, said first side member being movable between a first storage position generally adjacent said front frame and a second active position generally perpendicular to said front frame, a rear edge of said first side member including a vertically extending channel; a second side member hingedly connected to the rear surface of said front frame, said first side member being movable between a first storage position generally adjacent said front frame and a second active position generally perpendicular to said front frame, a rear edge of said second side member including a vertically extending channel; a rear panel slidably receivable within said channels of said first and second side members; a support shelf frame comprising a front support and first and second side supports, said front support and said first and second side supports each including at least one pin receiving area; wherein said first and second side members each include a side support shelf pin; wherein said front frame includes front support shelf pins; wherein said first and second side supports of said support shelf frame are removably positioned such that said pin receiving areas engage said side support shelf pins and said front support of said support shelf frame is removably positioned such that said pin receiving areas engage said front support shelf pins.

BRIEF DESCRIPTION OF THE DRAWING FIGURES

For further understanding of the nature and objects of the present invention, reference is made to the following detailed description taken in conjunction with the accompanying drawings in which like parts are given like reference numerals, wherein.

DETAILED DESCRIPTION OF THE PREFERRED EMBODIMENTS

Figure 1:
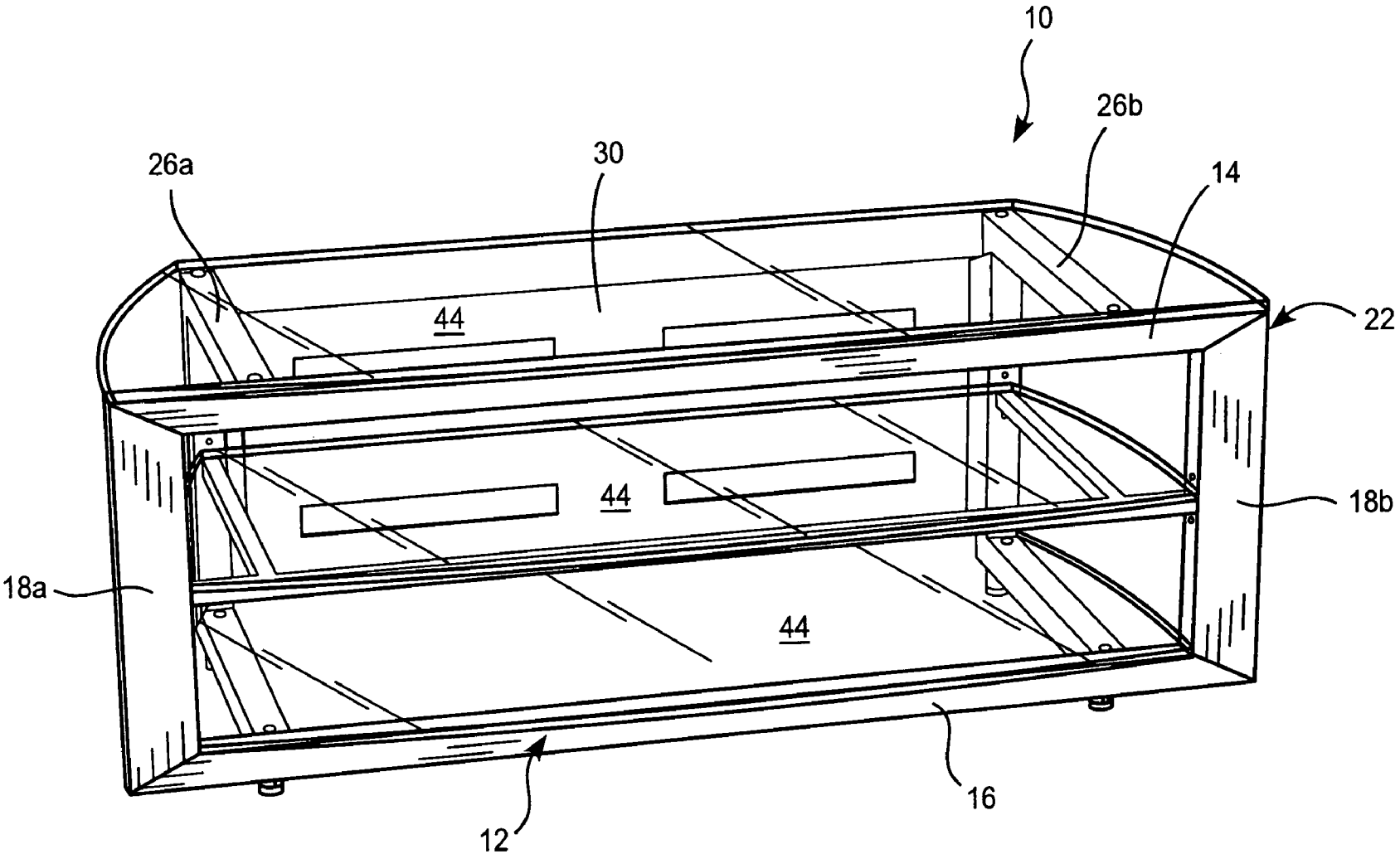
FIG. 1 is a perspective view of the home entertainment system storage unit according to a preferred embodiment thereof.

The present invention is directed to a home entertainment system storage unit, as generally shown by reference numeral 10 in FIG. 1. The storage unit 10 comprises a front frame 12 including an upper portion 14, a lower portion 16 preferably parallel thereto, and opposing side portions 18*a*, 18*b*, such that a generally quadrilateral frame is defined. The storage unit 10 further includes side members 26*a*, 26*b* projecting from a rear surface 22 of the front frame 12, and a rear panel 30 removably engaged with the side members 26*a*, 26*b*, as explained in greater detail below. The storage unit 10 preferably includes at least two, and more preferably three, shelves 44, which are preferably made from glass and are transparent, although other materials and other glass qualities could of course also be used. As shown in FIG. 1, home entertainment system storage unit 10 is an aesthetically pleasing, high quality furniture piece, absent of unsightly holes, screws, and the like usually associated with "assembly-required" furniture. Home entertainment system storage unit 10 is preferably packaged as a flat pack box, which is then removed from the packaging and assembled by the user, as described in detail below.

Figure 2:
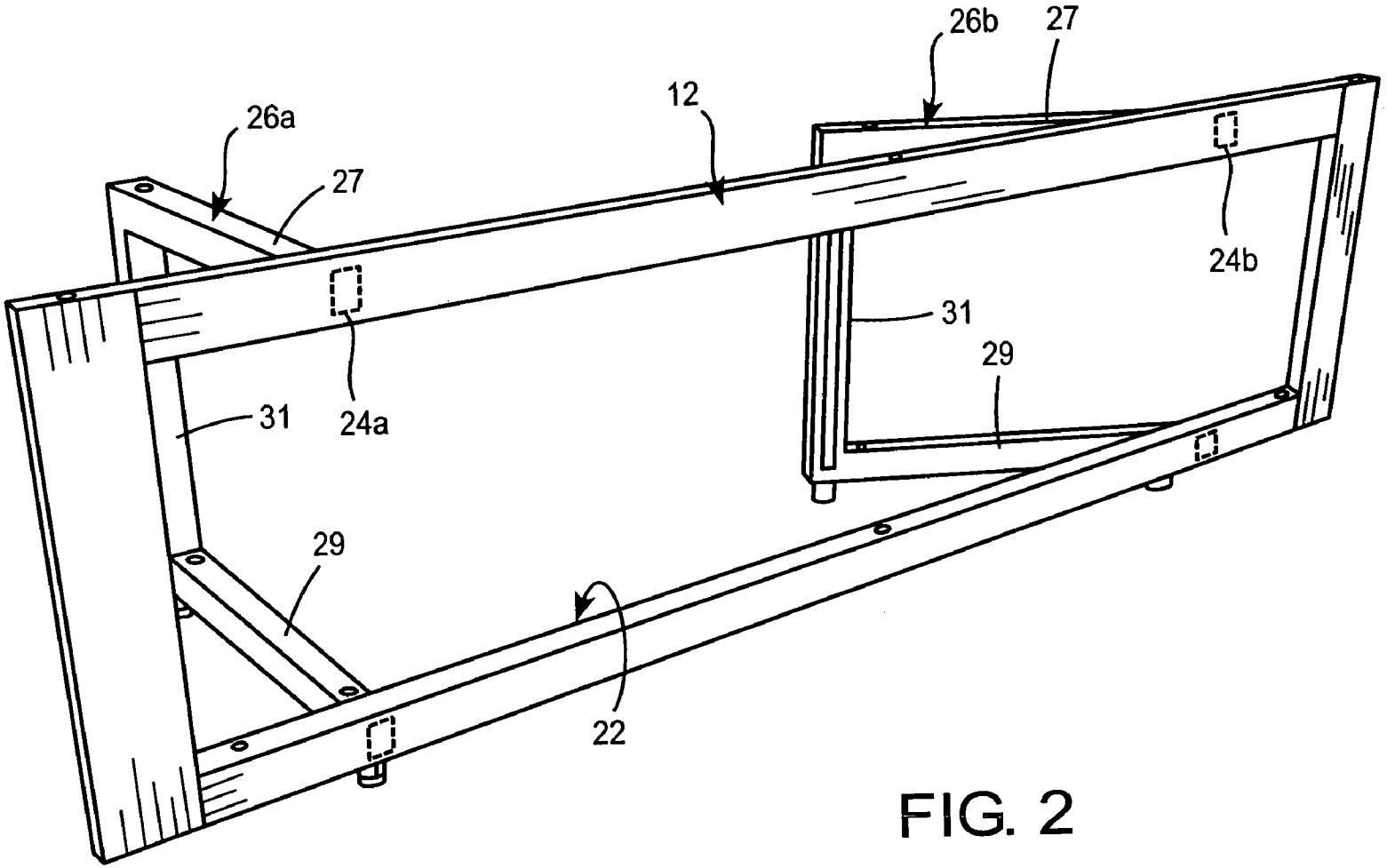
FIG. 2 is a perspective view thereof in a partially unfolded configuration.
Figure 3:
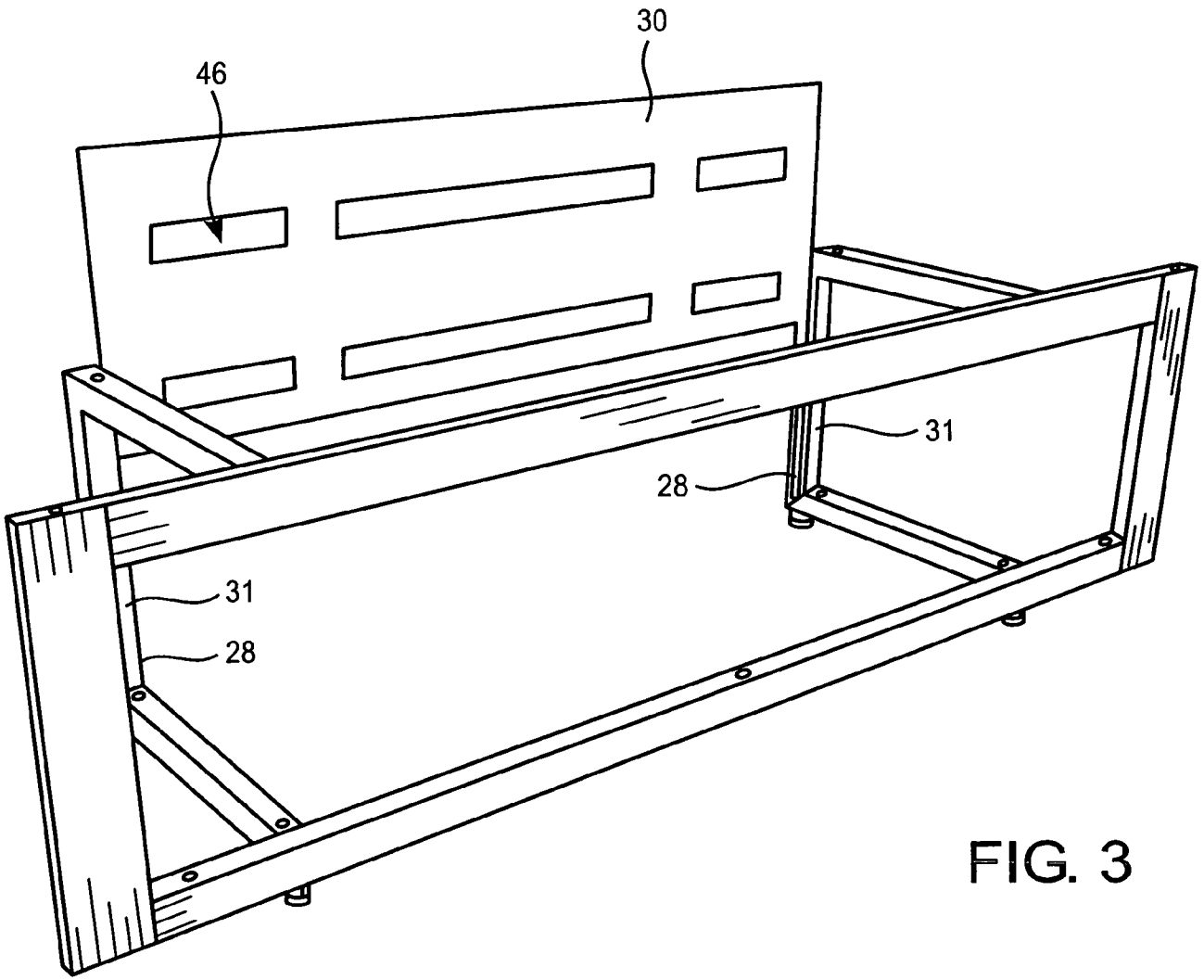
FIG. 3 is a perspective view thereof illustrating insertion of the rear panel.

Referring also to FIG. 2, side members 26*a*, 26*b* are hingedly connected to a rear surface 22 of the front frame 12 such that during packaging and shipping of the storage unit 10, i.e. in a flat pack box, side members 26*a*, 26*b* are disposed substantially parallel against the rear surface of the front frame. Upon removal from the packaging and set-up by a store clerk or consumer, however, the side members 26*a*, 26*b* are preferably pivoted about hinges 24*a*, 24*b* so as to obtain an orientation substantially perpendicular to the front frame 12. As illustrated, each side member 26*a*, 26*b* preferably include an upper support 27, a lower support 29 parallel to upper support 27, and a vertically extending rear support 31 extending between the upper support 27 and the lower support 29. As shown in FIG. 3, each rear support 31 preferably includes a vertically extending receiving channel or groove 28 into which rear panel 30 is slidably positioned by the user. The channels or grooves 28 are preferably attached to the inner surface of the rear support 31, so as to not disrupt the streamlined appearance of the side members or reduce the structural integrity thereof. It is conceivable, however, that grooves 28 could be formed within the side members by removing a portion of the material defining the rear support 31. The openings 46 preferably formed in the rear panel 30 allow easy access for wiring connections to the home entertainment system components and the passage of air therethrough so as to avoid heat retention. The specific number and arrangement of the openings 46 should not be limited to that shown, as any configuration could be used to achieve the desired goals. Moreover, it is also possible that a solid rear panel could be used, or perhaps a rear panel with only a central opening.

Figure 4:
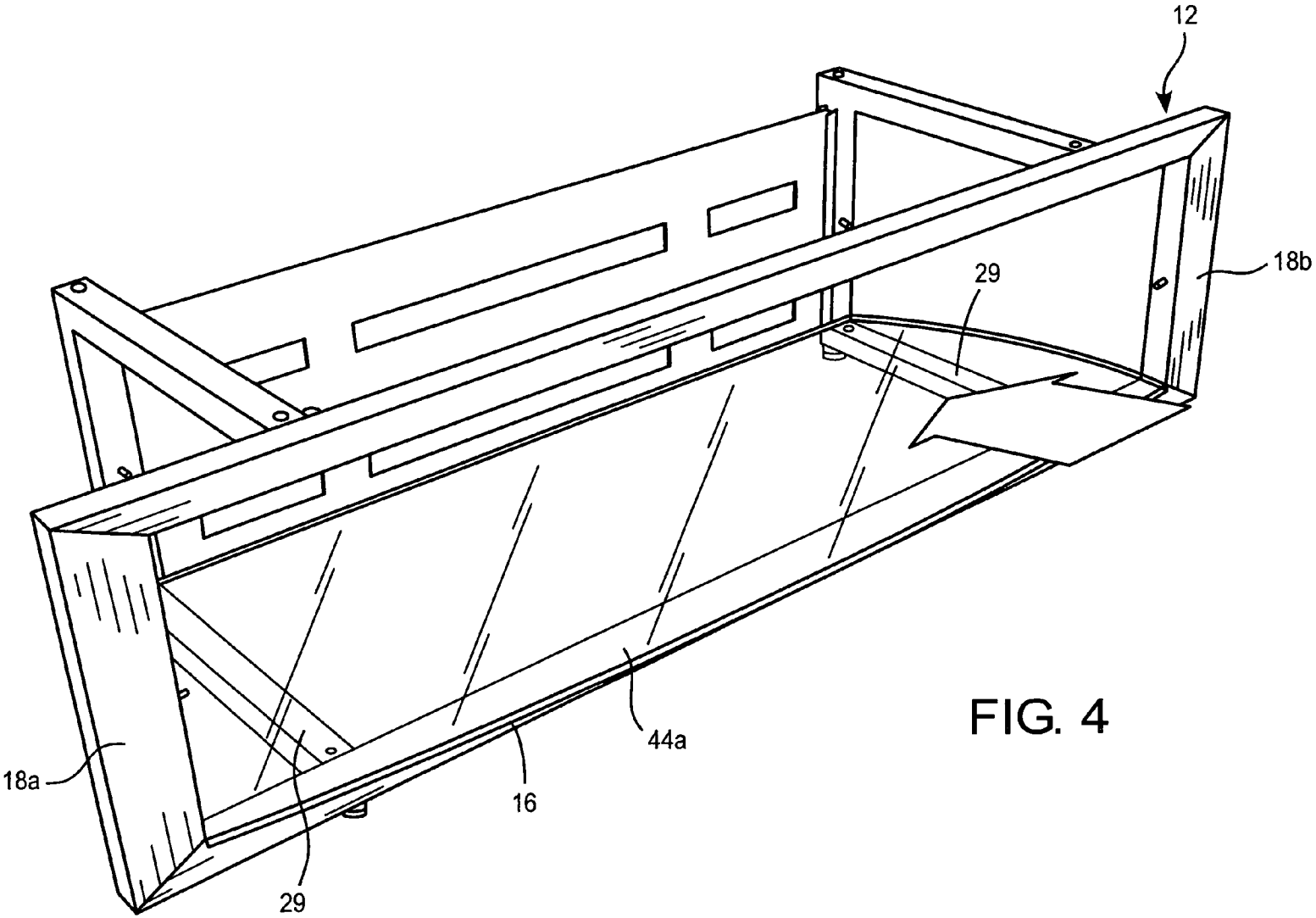
FIG. 4 is a perspective view thereof illustrating positioning of a lower shelf within the storage unit.

After assembly of the structural frame for the storage unit 10, the shelves 44 can be positioned in the desired position. As shown in FIG. 4, a first shelf 44*a* is positioned between the side members 18*a*, 18*b* of the front frame 12 and carefully placed on the lower supports 29. The lower supports 29 and the lower portion 16 of the front frame 12 thus support the shelf 44*a* against movement.

Figure 5:
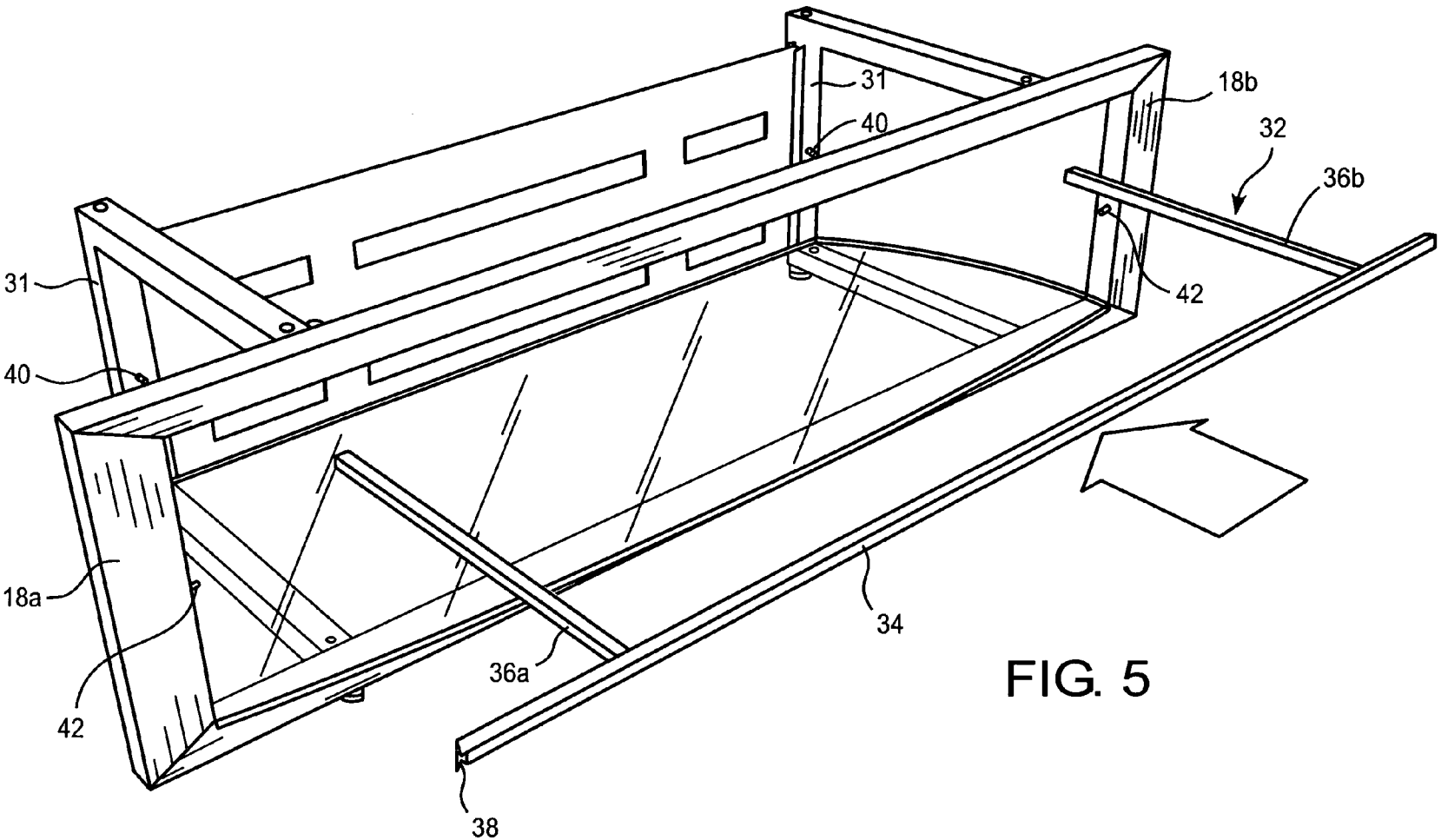
FIG. 5 is a perspective view thereof illustrating insertion of a middle shelf support bracket.
Figure 6:
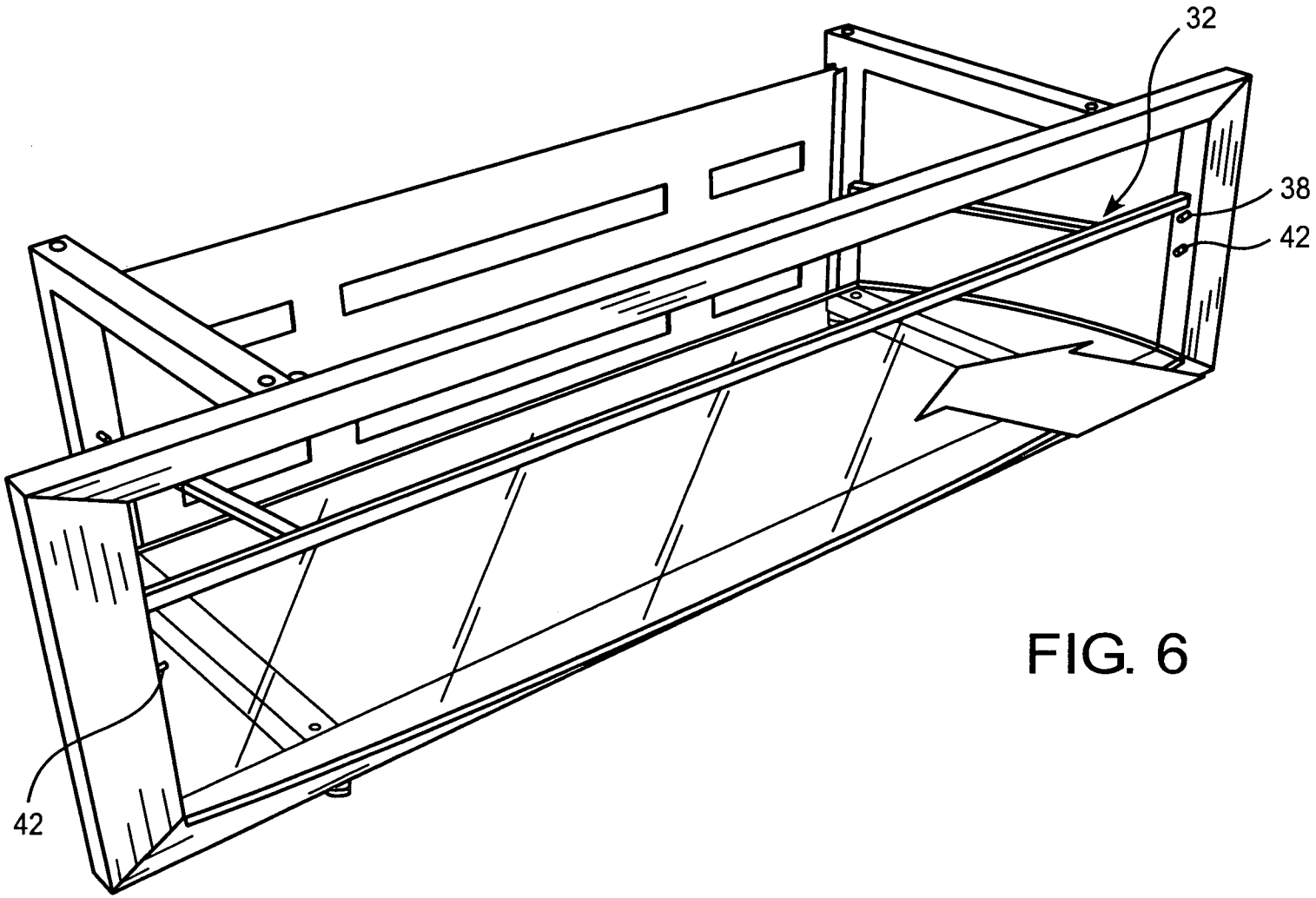
FIG. 6 is a perspective view thereof illustrating engagement of the middle shelf support bracket with engagement pins on the rear supports.
Figure 7:
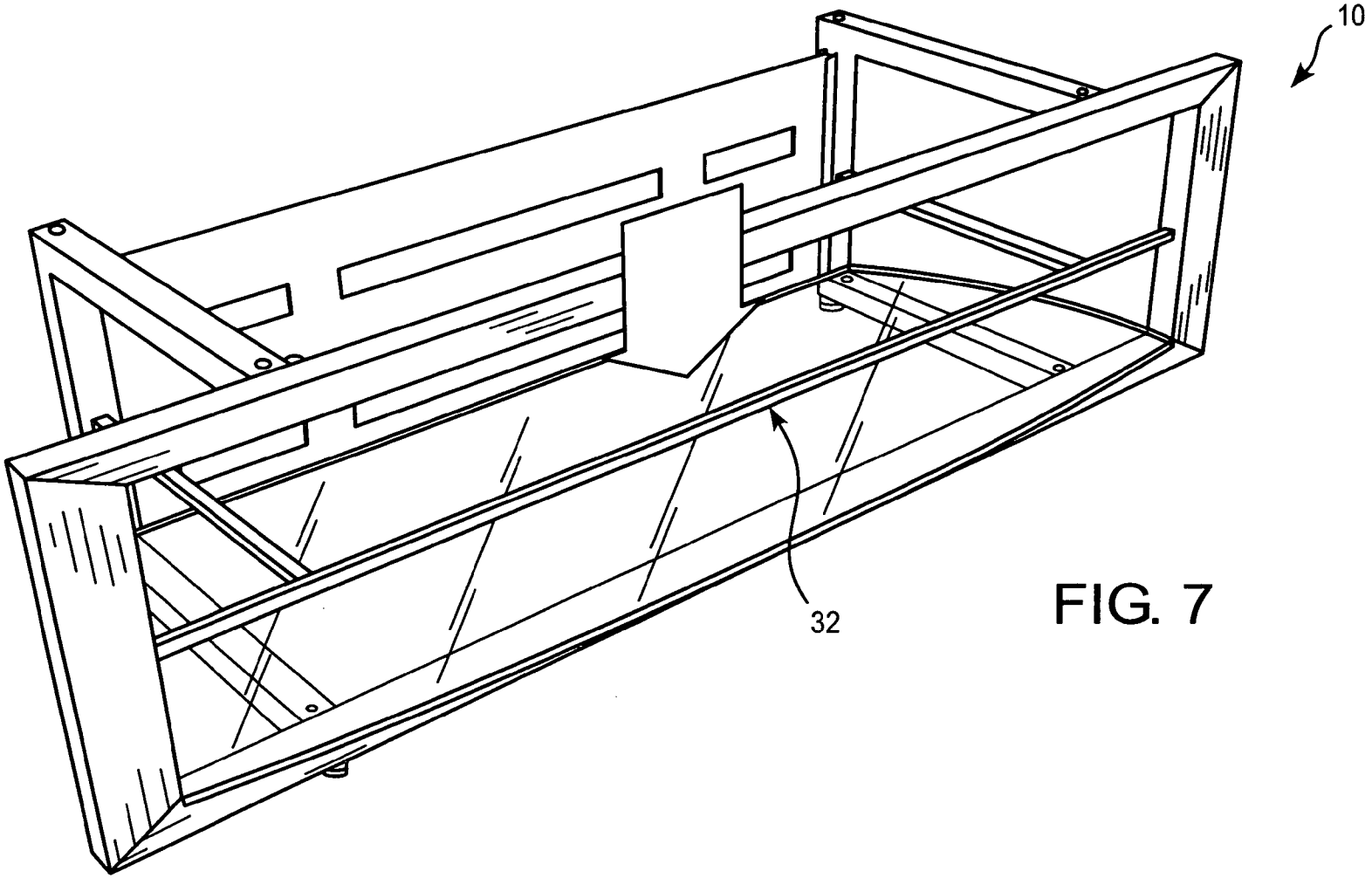
FIG. 7 is a perspective view thereof illustrating engagement of the middle shelf support bracket with engagement pins on the front frame.

With the first glass shelf 44*a* safely positioned, the user may then position the middle shelf support 32 which will support a second shelf 44*b*. Referring to FIG. 5, the middle shelf support 32 includes a front support 34 and two side supports 36*a*, 36*b* disposed perpendicular thereto. Each of the front support 34 and the side supports 36*a*, 36*b* includes a pin receiving area 38. The pin receiving area 38 is preferably defined by the U-shaped configuration of the support throughout the length thereof, however, if desired, the support may comprise a pin receiving area only in the required end portions and the remainder of the support may be solid or otherwise configured. As shown in FIG. 5, the rear supports 31 of the side members 26*a*, 26*b* each include a rear shelf pin 40 and the side portions 18*a*, 18*b* of the front frame each include a front shelf pin 42. Referring also to FIG. 6, the middle shelf support 32 is positioned so that the pin receiving areas 38 of the side supports 36*a*, 36*b* engage the rear shelf pins 40 on the rear supports 31. Preferably, this is accomplished by inserting the middle shelf support 32 at a slight angle as shown in FIG. 6. Thereafter, the front support 34 of the middle shelf support 32 is brought to a level horizontal position and in so doing the pin receiving areas 38 of the front support 34 engage the front shelf pins 42 projecting from the side portions of the front frame 12, thereby securing the middle shelf support at a predetermined location within the storage unit 10 as shown in FIG. 7. The location of the front shelf pins and the rear shelf pins are preferably predetermined at the factory and are thereby fixed in their location. Alternatively, however, a plurality of holes may be formed in the front frame and the rear supports to selectively receive the shelf pins depending upon the particular application by the user.

Figure 8:
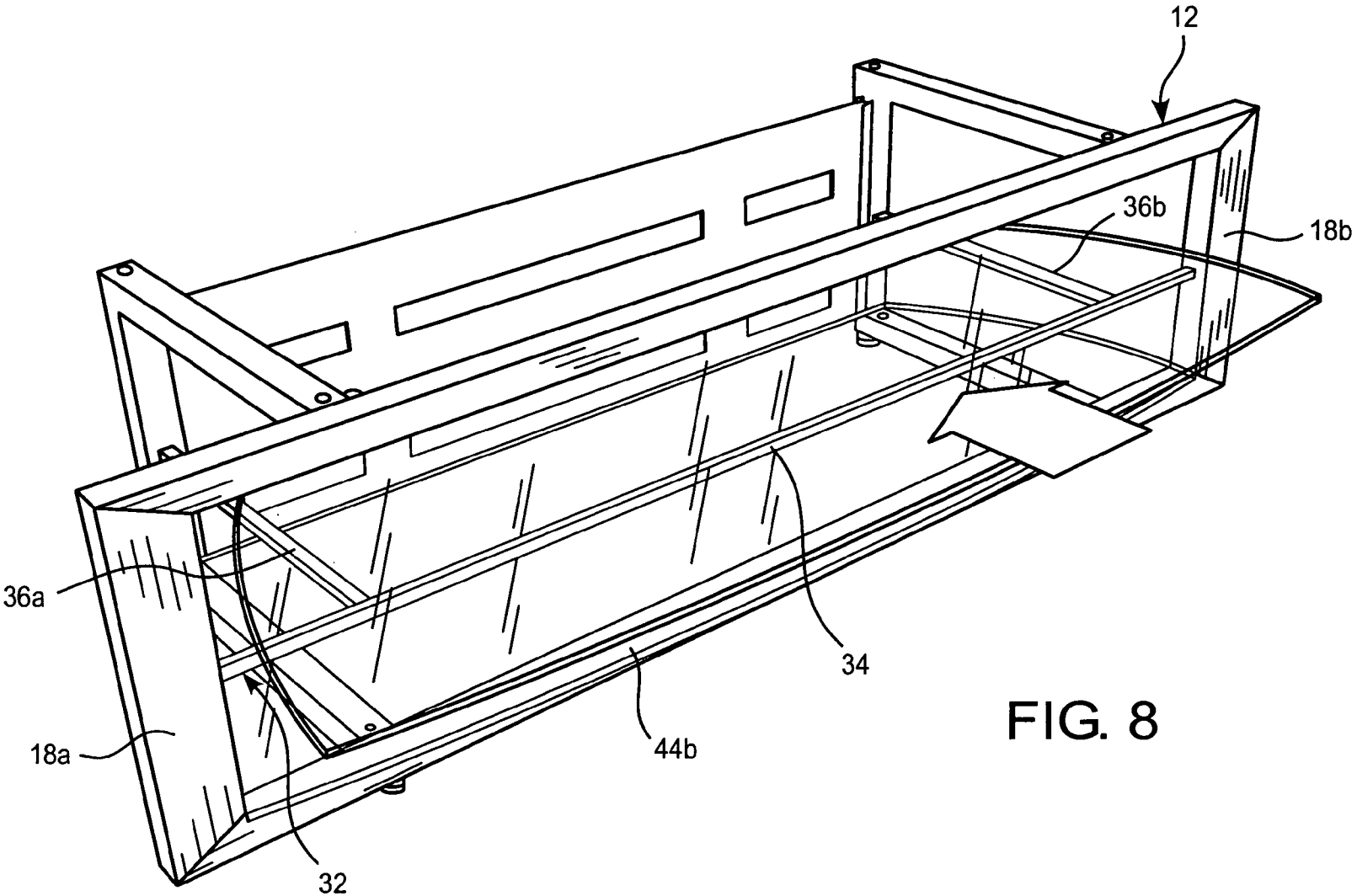
FIG. 8 is a perspective view thereof illustrating positioning of a middle shelf on the middle shelf support bracket.

Referring to FIG. 8, a second shelf 44*b* is positioned between the side members 18*a*, 18*b* of the front frame 12 and carefully placed on the middle shelf support 32. The front support 34 and the side supports 36*a*, 36*b* thus support the shelf 44*b* against movement.

Figure 9:
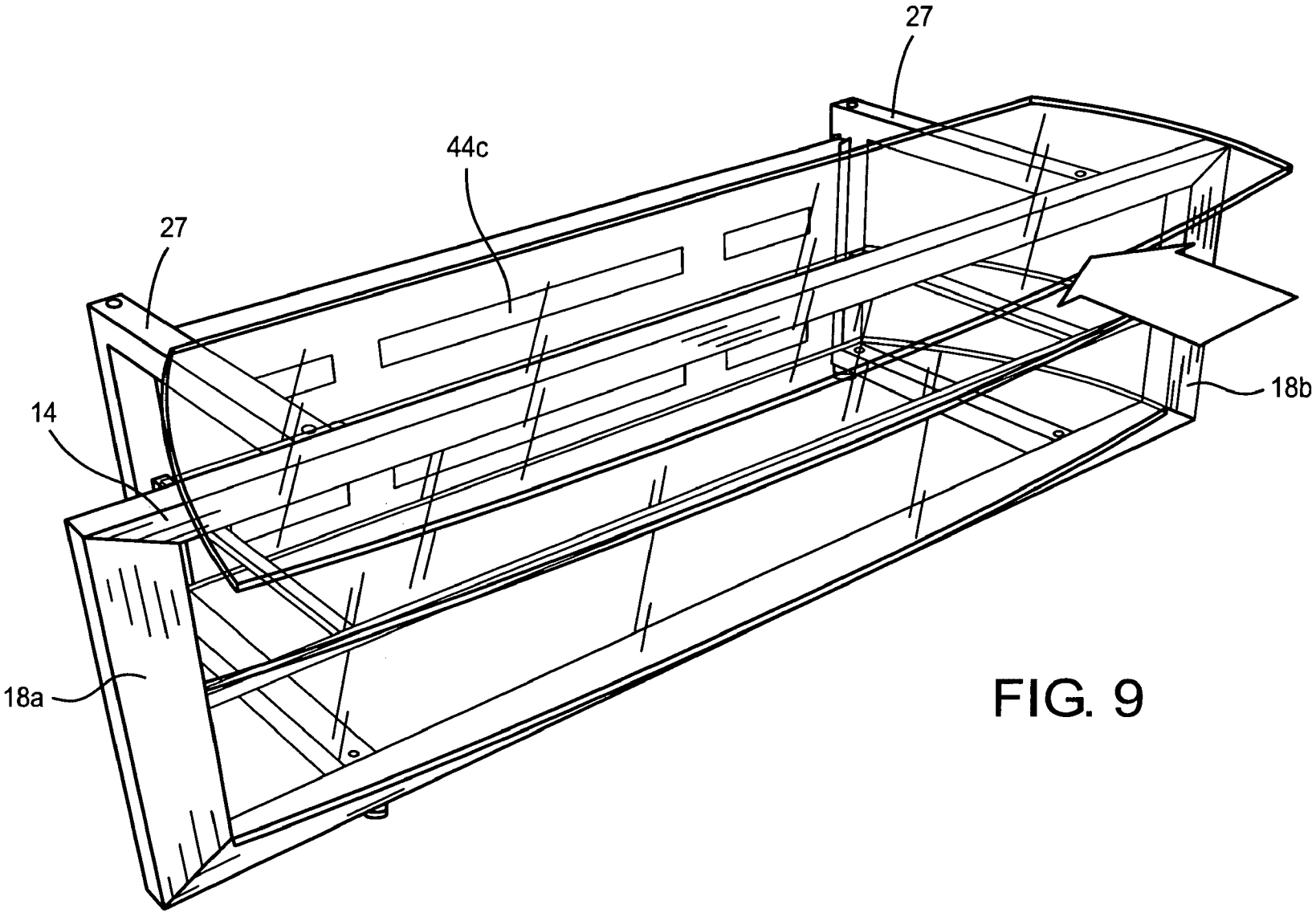
FIG. 9 is a perspective view thereof illustrating positioning of an upper shelf within the storage unit.

Similarly, as shown in FIG. 9, a third shelf 44*c* is positioned between the side members 18*a*, 18*b* of the front frame 12 and carefully placed on the upper supports 27 of the side members 26*a*, 26*b*. The upper supports 27 and the upper portion 14 of the front frame 12 thus support the shelf 44*c* against movement.

Figure 10:
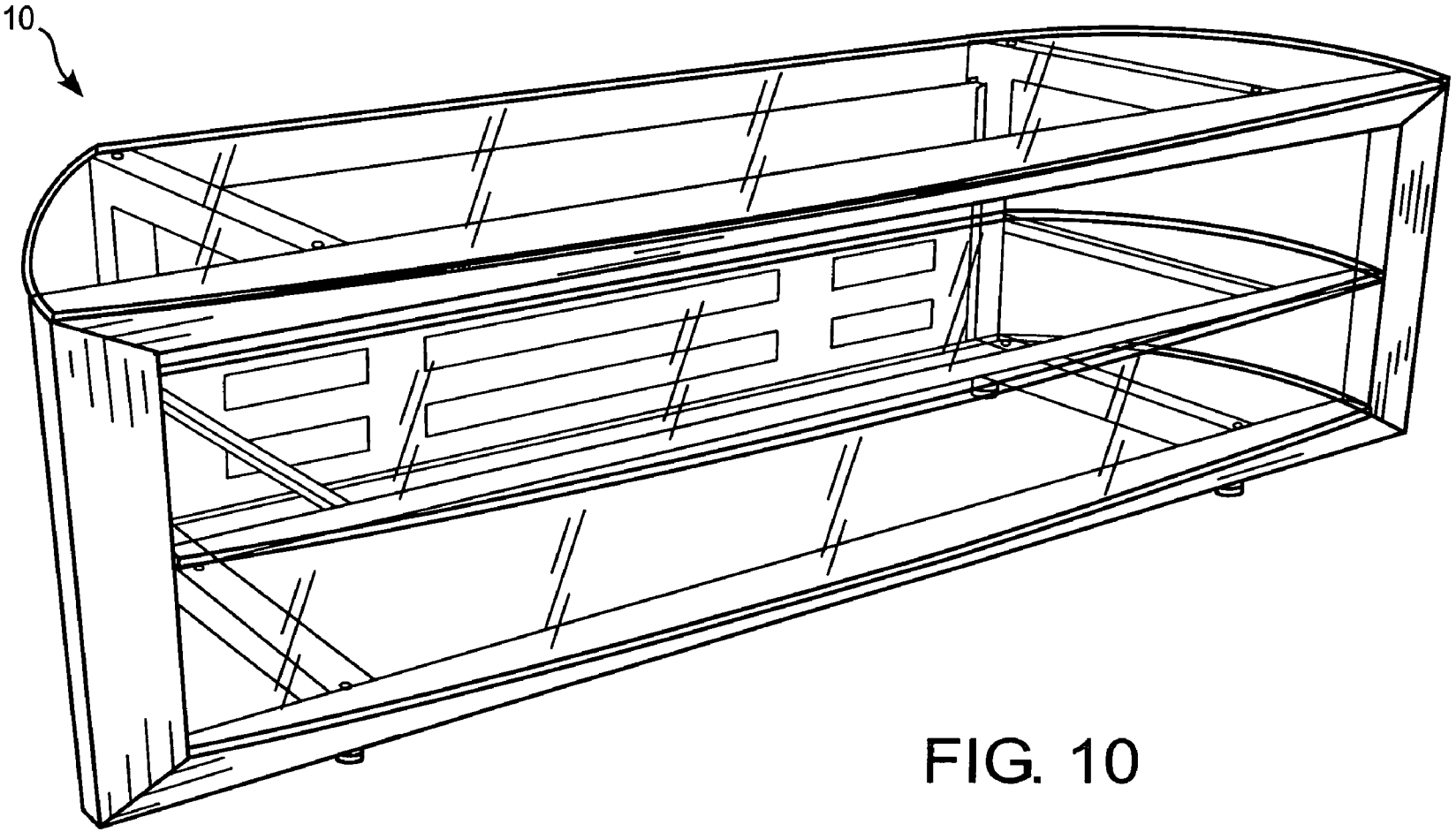
FIG. 10 is a perspective view of the fully assembled storage unit.

FIG. 10 illustrates a preferred embodiment of the present invention having three support shelves for holding home entertainment system components. It should be clear to one skilled in the art however that the invention also includes all conceivable combinations of the preferred embodiments and examples described above. That is, the middle shelf support and middle shelf may be optionally omitted if desired by the consumer, or additional shelf supports and further shelves may be included if a storage unit with greater storage space is required.

Although only preferred embodiments and examples are specifically illustrated and described herein, it will be appreciated that many modifications and variations of the present invention are possible in light of the above teachings and within the purview of the appended claims without departing from the spirit and intended scope of the invention.

What is claimed is:

1. A home entertainment system storage unit comprising:

a front frame having an upper portion, a bottom portion, and first and second side portions extending therebetween;

a first side member hingedly connected to a rear surface of said front frame, said first side member being movable between a first storage position generally adjacent said front frame and a second active position generally perpendicular to said front frame, a rear edge of said first side member including a vertically extending channel;

a second side member hingedly connected to the rear surface of said front frame, said second side member being movable between a first storage position generally adjacent said front frame and a second active position generally perpendicular to said front frame, a rear edge of said second side member including a vertically extending channel;

a rear panel slidably receivable within said channels of said first and second side members;

a support shelf frame comprising a front support and first and second side supports, said front support and said first and second side supports each including at least one pin receiving area;

wherein said first and second side members each include a side support shelf pin;

wherein said front frame includes front support shelf pins;

wherein said first and second side supports of said support shelf frame are removably positioned such that said pin receiving areas engage said side support shelf pins and said front support of said support shelf frame is removably positioned such that said pin receiving areas engage said front support shelf pins.

2. The home entertainment system storage unit according to claim 1, further comprising a plurality of support shelves.

3. The home entertainment system storage unit according to claim 2, wherein said plurality of shelves are made of glass.

4. The home entertainment system storage unit according to claim 1, wherein each of said first and second side members includes an upper support, a lower support, and a rear support extending therebetween.

5. The home entertainment system storage unit according to claim 4, wherein said rear support includes said vertically extending channel.

6. The home entertainment system storage unit according to claim 1, wherein said at least one pin receiving area is defined by an open U-shaped configuration of said front support and said first and second side supports of said support shelf frame.

7. The home entertainment system storage unit according to claim 1, wherein said rear panel includes a plurality of openings.

8. A method of assembling a home entertainment system storage unit, said method comprising:

providing a frame assembly including a front frame having an upper portion, a bottom portion, and first and second side portions extending therebetween; a first side member hingedly connected to a rear surface of said front frame, said first side member being movable between a first storage position generally adjacent said front frame and a second active position generally perpendicular to said front frame, a rear edge of said first side member including a vertically extending channel; and a second side member hingedly connected to the rear surface of said front frame, said second side member being movable between a first storage position generally adjacent said front frame and a second active position generally perpendicular to said front frame, a rear edge of said second side member including a vertically extending channel;

unfolding said first side member from the first storage position to the second active position;

unfolding said second side member from the first storage position to the second active position;

positioning a rear panel above said vertically extending channels on the rear edges of said first and second side members and sliding the rear panel downward within said channels;

providing a first shelf, the first shelf being separate and detached from the frame assembly, and removably positioning the first shelf on a bottom portion of the front frame and a lower member of each of the side members;

providing a second shelf, the second shelf being separate and detached from the frame assembly, and removably positioning the second shelf on an upper portion of the front frame and an upper member of each of the side members;

providing a support shelf frame having a plurality of pin receiving areas;

providing a plurality of engagement pins on said side members and on said front frame;

positioning said support shelf frame between opposing side portions of said front frame such that said pin receiving areas engage said pins, thereby securing said support shelf frame in place; and positioning a third shelf on the support shelf frame.

* * * * *